US005676276A

United States Patent [19]

Zielinski et al.

[11] Patent Number: 5,676,276

[45] Date of Patent: Oct. 14, 1997

[54] BUFFET TABLE FOOD PAN

[75] Inventors: David J. Zielinski; Steven R. Lawson, both of Oklahoma City, Okla.

[73] Assignee: Carlisle FoodService Products, Incorporated, Oklahoma City, Okla.

[21] Appl. No.: 558,473

[22] Filed: Nov. 16, 1995

[51] Int. Cl.[6] ..... B65D 1/34; B65D 1/40; B65D 6/04

[52] U.S. Cl. ..... 220/657; 206/557; 220/574; 220/669

[58] Field of Search ..... 220/657, 574, 220/669; 206/557

[56] References Cited

U.S. PATENT DOCUMENTS

| | | | |
|---|---|---|---|
| D. 333,944 | 3/1993 | Denzin et al. . | |
| 202,939 | 4/1878 | Frost et al. | 220/574 |
| 3,179,287 | 4/1965 | Rickmeier, Jr. . | |
| 3,268,144 | 8/1966 | Gaunt | 220/669 X |
| 3,344,974 | 10/1967 | Bostrom | 220/657 X |
| 4,113,095 | 9/1978 | Dietz et al. | 220/669 X |
| 4,386,703 | 6/1983 | Thompson et al. | 220/23.8 X |
| 4,425,368 | 1/1984 | Watkins | 220/367.1 X |
| 4,660,734 | 4/1987 | Heaney et al. . | |
| 4,694,950 | 9/1987 | Macleod, Jr. | 206/557 X |
| 4,828,112 | 5/1989 | Vollrath et al. . | |

FOREIGN PATENT DOCUMENTS

| | | | |
|---|---|---|---|
| 0172081 | 2/1986 | European Pat. Off. | 206/557 |

OTHER PUBLICATIONS

Pp. 29 and 30 from Cambro 1991 Product Catalog, Jan. 1, 1991.

*Primary Examiner*—Allan N. Shoap
*Assistant Examiner*—Niki M. Kopsidas
*Attorney, Agent, or Firm*—Dougherty, Hessin, Beavers & Gilbert

[57] ABSTRACT

A buffet table food pan having a pair of side walls and a pair of end walls extending upwardly from a bottom panel. A top flange extends outwardly from the walls. The flange is in sealing engagement with the buffet table when it is placed therein. The flange has a notch defined at each end, so that a space is defined between the flange and the table. The space defines a ledge which can be grabbed, or under which utensils can be placed for the purpose of lifting the pan or removing the pan from the table.

19 Claims, 2 Drawing Sheets

BUFFET TABLE FOOD PAN

BACKGROUND OF THE INVENTION

This invention relates to food pans and more specifically to food pans for use in buffet and/or steam tables (referred to collectively herein as buffet tables).

Food pans that are used in buffet tables hold various kinds of hot and cold foods. The pans must be removed from the table periodically for various reasons. For instance, food pans must be removed and replaced to replenish the food in the table, and must be removed to clean the pan and the table. Food pans used in buffet tables must also be configured to provide a seal between the pan and the table so that steam or cold air below the pan will not escape around the edges of the pan.

Prior art food pans are typically constructed with a top flange having either a downturned outer edge or a flange having an outwardly extending portion which rests on and provides a seal with the table in which the food pan is placed. Although such pans may provide an adequate seal so that food placed in the food pan is maintained at a desirable temperature by the steam or cold air therebelow, it is difficult to remove such pans from the table. To remove the pans, the edge of the pan, which provides the seal with the table, must somehow be lifted from the table, either by wedging a finger, utensil or other tool under the pan. Such a procedure is difficult and can be dangerous since the table may have a hot upper surface which can burn the hand or finger of the person removing the pan. Thus, there is a need for a food pan which can be easily removed from a buffet table, and which provides a seal between the pan and the table.

SUMMARY OF THE INVENTION

The food pan of the present invention solves the difficulties inherent in prior art food pans by providing a food pan which can be easily removed from a buffet table and which provides a seal between the table and the food pan.

The food pan of the present invention includes a bottom panel having four walls extending upwardly therefrom. The four walls may include first and second end walls and first and second side walls. The end walls are joined to the sidewalls at curved corners thereof, and define a generally rectangular top opening.

A top flange extends outwardly from the four walls around the entire periphery of the walls. The top flange has a continuous planar lower surface so that when the food pan is placed in a buffet table, the continuous planar lower surface is in intimate contact with the upper surface of a buffet table around the periphery of the pan. Thus, the pan is in sealing engagement with the buffet table when the pan is placed therein.

At least one overhanging ledge is defined on the top flange. The food pan preferably includes two overhanging ledges defined on the flange, one each at opposed ends of the food pan. The top flange has an upper flange portion and a lower flange portion, with the continuous planar lower surface being defined on the lower flange portion. The upper flange portion extends outwardly from the lower flange portion in at least one location around the periphery of the flange thereby defining the overhanging ledge. Preferably, the lower flange portion extends outwardly from the upper flange portion around the entire periphery of the flange except where the overhanging ledge is defined. The lower flange portion has a recess at the position on the flange where the overhanging ledge is defined, so that an outer edge of the lower flange portion is displaced inwardly from an outer edge of the upper flange portion thereby defining the overhanging ledge.

The recess in the lower flange portion is generally rectangular in shape, so that the overhanging ledge is likewise generally rectangular. The lower surface of the overhanging ledge is spaced vertically upward from the continuous planar lower surface of the lower flange portion, so that when the pan is placed in a buffet table, a space is defined between the upper surface of the buffet table and the top flange. Specifically, a space is defined between the upper flange portion where the overhanging ledge is defined and the upper surface of the buffet table. The space is such that the overhanging ledge can be easily grabbed and the pan lifted from the table. The ends of common utensils may also be placed underneath the overhanging ledge and used to lift the pan so that a better grip can be obtained on the flange. Thus, the overhanging ledge constitutes a lifting means for lifting the food pan from a buffet table.

The food pan of the present invention can be made of any suitable material, and is preferably made from polycarbonate or polysulfone material.

DESCRIPTION OF A PREFERRED EMBODIMENT

Figure 1:
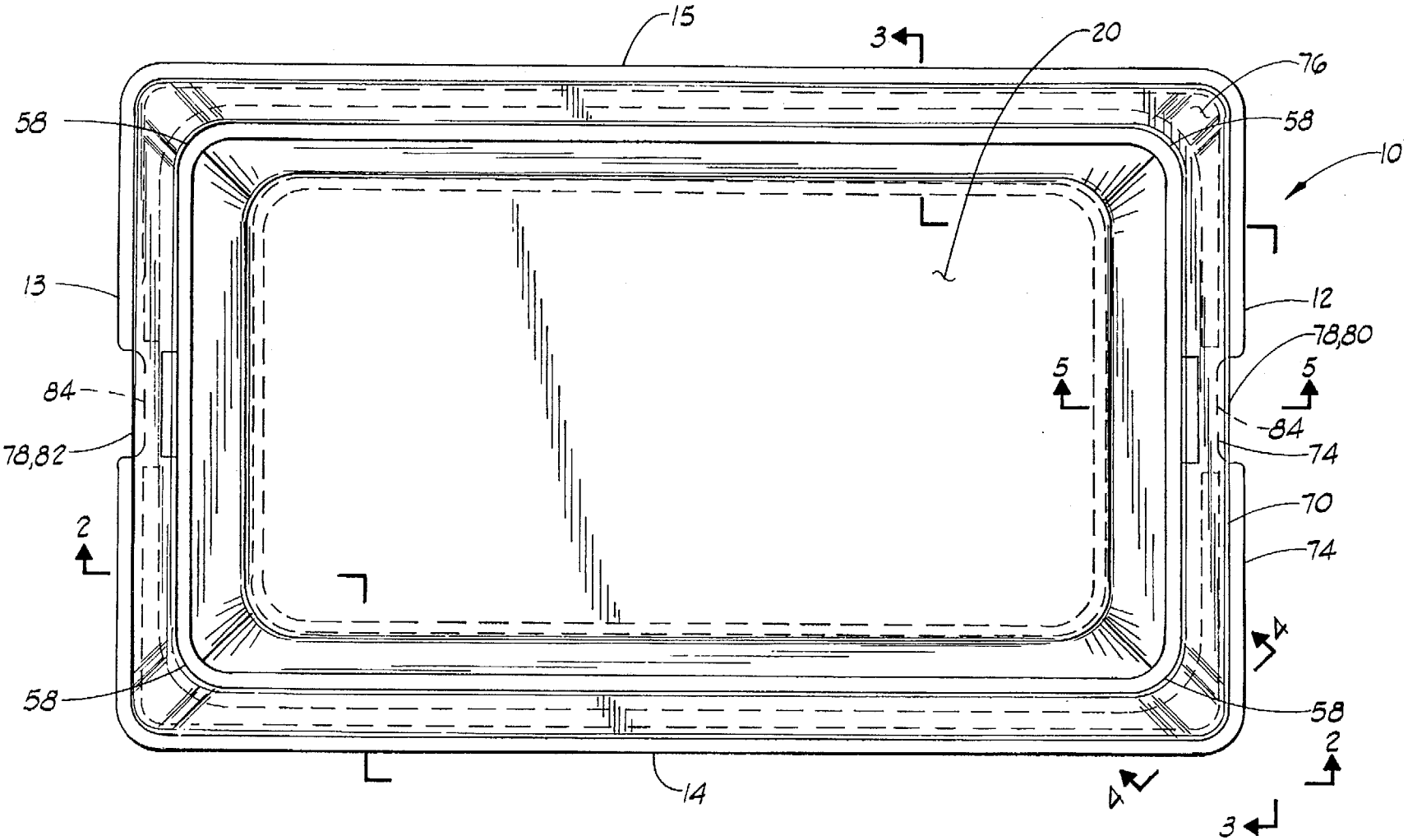
FIG. 1 is a top view of the food pan of the present invention.

Referring now to the drawings, and particularly to FIGS. 1–5, the food pan of the present invention is shown and generally designated by the numeral 10. The food pan has first and second opposed ends 12 and 13 respectively, and first, or left and second, or right, opposed sides 14 and 15 respectively. Food pan 10 includes a bottom panel 20 having four walls 30 extending upwardly therefrom. A lip 11 extends downward from bottom panel 20. The lip is generally rectangular shaped. When food pan 10 is placed on a flat surface, lip 11 will prevent contact between bottom panel 20 and the flat surface. Walls 30 are joined to and merged with bottom panel 20 at curved corners 35. Walls 30 may be comprised of a lower wall section 31 and an upper wall section 32. Lower wall section 31 extends upward from bottom panel 20 and has a ridge 33 extending outwardly from an upper end 34 thereof. Upper wall section 32 extends upwardly from ridge 33.

The walls 30 may comprise a pair of end walls 40 and a pair of side walls 45. End walls 40 may be comprised of a first or front end wall 50 and a second or rear end wall 52 while side walls 45 may be comprised of a first or left side wall 54 and a second or right side wall 56. The pair of end walls 40 are joined with and merged into the side walls 45 at curved corners 58.

Figure 2:
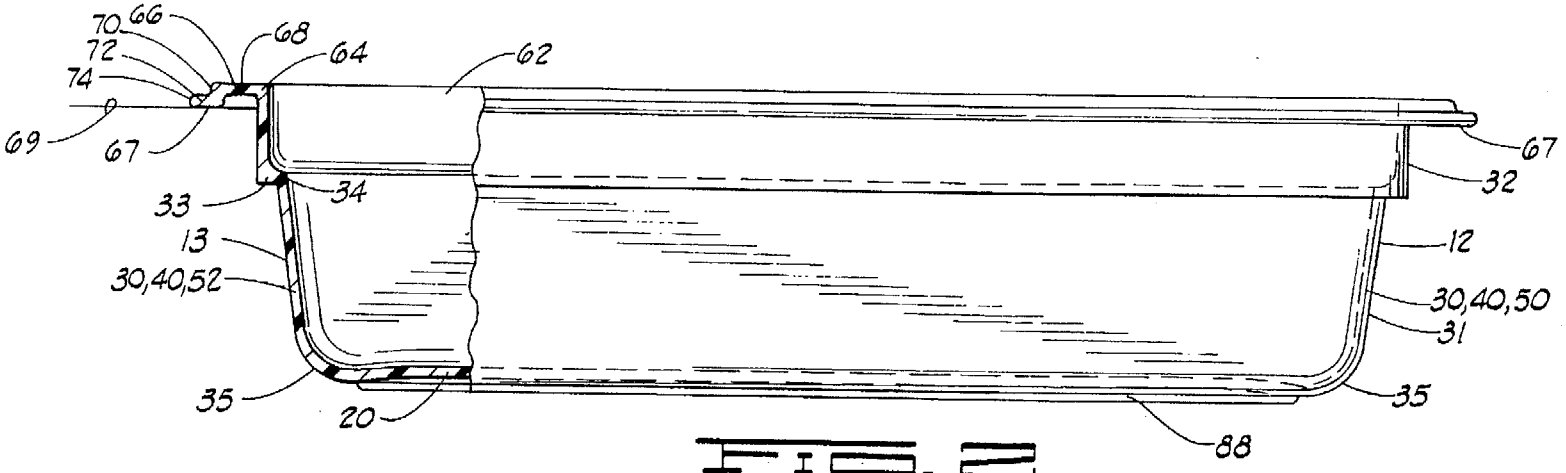
FIG. 2 is a view taken from line 2—2 of FIG. 1.
Figure 4:
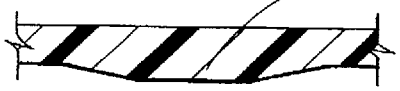
FIG. 4 is a view taken from line 4—4 of FIG. 1.
Figure 5:
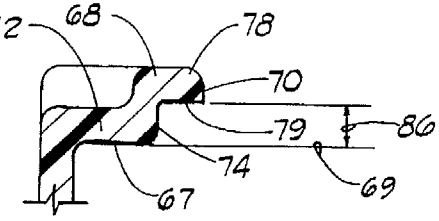
FIG. 5 is a view taken from line 5—5 of FIG. 1.
Figure 3:
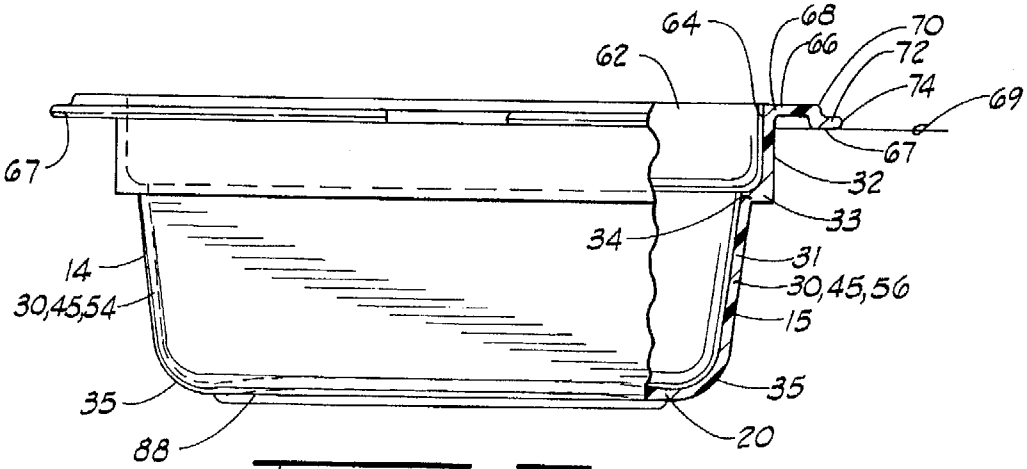
FIG. 3 is a view taken from line 3—3 of FIG. 1.

The walls 30 define a top opening 62 and terminate in an upper edge or upper end 64. Top opening 62 is generally rectangular in shape with the exception of the curved corners. A top flange 66 extends outwardly from the walls around the entire periphery thereof. Preferably, top flange 66 extends outwardly from upper edge 64. Top flange 66 has a continuous planar lower surface 67 so that when food pan 10 is placed in a buffet table, the flange will be in intimate, uninterrupted contact with an upper surface 69 of a buffet table as schematically shown in FIGS. 2, 3 and 5. Thus, the food pan will be in sealing engagement with the buffet table when it is located therein.

Top flange 66 is comprised of an upper flange portion 68 having an outer edge 70 and a lower flange portion 72 having an outer edge 74. The upper flange may include reinforcements 76 at the corners thereof. The reinforcements 76 are defined by an increased thickness of upper flange portion 68 at the corners of the flange, and are better seen in FIG. 4. Top flange 66 includes at least one overhanging ledge 78 having a lower surface 79, and preferably includes two overhanging ledges 78, located on the flange at the first and second ends respectively of the food pan.

As better seen in FIG. 5, upper flange portion 68 extends outwardly beyond lower flange portion 72 at at least one location around the periphery of the flange thereby defining the at least one overhanging ledge 78. In the embodiment shown, upper flange portion 68 extends outwardly beyond lower flange portion 72 at the two locations designated as locations 80 and 82, to define two overhanging ledges 78. The detail of the food pan at locations 80 and 82 is seen more clearly in FIG. 5. Preferably, lower flange portion 72 extends outwardly beyond upper flange portion 68 except at locations 80 and 82, where lower flange portion 72 includes recesses or notches 84. Upper flange portion 68 and thus outer edge 70 of the upper flange portion extends outwardly beyond the outer edge 74 of the lower flange portion 72, thereby defining the two overhanging ledges 78 at such locations. Recesses 84 are preferably generally rectangularly shaped recesses. Thus, the overhanging ledges 78 will likewise be generally rectangular shaped.

Because the flange has a continuous lower surface, the food pan will, when placed in a buffet table, be in intimate contact around the periphery of the flange so that steam or cold air in the table will maintain the food in the pan at the desired temperature. At the same time, the overhanging ledge provides a lifting means by which the pan can be easily removed from the table.

As seen from FIGS. 2, 3 and 5, continuous planar lower surface 67 will sealingly engage upper surface 69 of a buffet table. An access space 86 is defined between the top flange and the buffet table. Specifically, access space 86 is defined by the upper surface of the buffet table and lower surface 79 of overhanging ledge 78. The food pan can thus easily be removed by simply gripping the overhanging ledge, which is vertically spaced upward from the buffet table, and removing the pan. The ends of common utensils, such as knives, forks or spoons can also be inserted into the space for the purpose of lifting the food pan from the buffet table so that the edge of the pan can be easily grasped and the pan removed from the buffet table.

Thus, the food pan of the present invention provides a seal with the buffet table while at the same time providing an means for removing the pan from the table easily and efficiently. The food pan thus eliminates the difficulties associated with prior art pans by making it easier to remove pans and thus lessening the possibility of burns caused by trying to remove prior art pans from buffet tables.

The present invention has been described with respect to preferred embodiments. It will be clear to those skilled in the art that modifications and/or variations of the disclosed food pan can be made without departing from the scope of the invention claimed herein.

We claim:

1. A food pan comprising:

a bottom panel;

four walls extending upwardly from said bottom panel, said four walls having an upper end and defining a generally rectangular top opening; and a flange extending outwardly from said upper end of said walls, said flange having a continuous planar lower surface, said flange having at least one radially inwardly extending recess defined thereon, said at least one recess defining at least one overhanging ledge, said overhanging ledge having a lower surface spaced upwardly from said continuous planar lower surface.

2. The food pan of claim 1, wherein said flange is comprised of an upper flange portion and a lower flange portion, said continuous planar lower surface being defined on said lower flange portion.

3. The food pan of claim 1, wherein said flange comprises an upper flange portion and a lower flange portion, said recess being defined on said lower flange portion so that an outer edge of said lower flange portion is located inwardly from an outer edge of said upper flange portion thereby defining said overhanging ledge.

4. The food pan of claim 3, said lower flange portion extending outwardly from said upper flange portion except where said recess is defined on said lower flange portion, wherein said upper flange portion extends outwardly beyond said lower flange portion.

5. The food pan of claim 4, wherein said at least one overhanging ledge comprises two overhanging ledges, one each of said overhanging ledges being located at opposed ends of said pan.

6. The food pan of claim 1 wherein said four walls comprise a pair of end walls and a pair of side walls, said at least one recess comprising two recesses, one each located at opposed ends of said pan, thereby defining two overhanging ledges, one each located at opposed ends of said pan.

7. The food pan of claim 6, wherein said flange comprises an upper flange portion and a lower flange portion, said lower flange portion having one said recess at each of said ends of said pan, said upper flange portion extending outwardly beyond said recesses thereby defining an overhanging ledge at each end.

8. The food pan of claim 7, wherein said end walls and said side walls comprise a lower section and an upper section, said lower section extending upwardly from said bottom panel and having a ridge extending outwardly from an upper end thereof, said upper section extending upwardly from said ridge.

9. The food pan of claim 1, wherein said food pan is comprised of polycarbonate material.

10. The food pan of claim 1, wherein said food pan is comprised of polysulfone material.

11. A food pan for a buffet table of the type having an upper surface and an opening for receiving said food pan, said food pan comprising:

a bottom panel;

first and second opposed end walls and first and second opposed side walls extending upwardly from said bottom panel, said end walls and said side walls being joined at the corners thereof and defining a generally rectangular top opening; and a top flange extending outwardly from said walls, said top flange having a continuous planar lower surface, said flange thereby being adapted to be in uninterrupted intimate contact with the upper surface of said buffet table when said pan is placed therein, said top flange having a recess defined therein, said recess extending radially inwardly from an edge of said flange to provide an overhanging ledge for defining a space between the buffet table upper surface and said top flange when the pan is received in the buffet table.

12. The food pan of claim 11, wherein said top flange comprises an upper flange portion and a lower flange portion, said continuous planar lower surface being defined on said lower flange portion.

13. The food pan of claim 12, wherein said recess is defined on said lower flange portion and said overhanging ledge is defined on said upper flange portion so that the to be defined space between the buffet table upper surface and said top flange is defined between said upper flange portion and the upper surface of the buffet table.

14. The food pan of claim 12, wherein said at least one recess comprises two recesses, one each at opposed ends of said pan, so that the to be defined space between the buffet table and said upper flange portion comprises two spaces, one at each end of said food pan.

15. The food pan of claim 14, wherein said recess is generally rectangular in shape.

16. The food pan of claim 11, wherein said at least one recess comprises two recessed, one each at opposed ends of said pan, so that the to be defined space between the buffet table and said upper flange portion comprises two spaces, one at each end of said food pan.

17. The food pan of claim 11, wherein said overhanging ledge comprises a lifting means for lifting said pan from the buffet table.

18. The food pan of claim 11, wherein said food pan is comprised of polycarbonate material.

19. The food pan of claim 11, wherein said food pan is comprised of polysulfone material.

* * * * *

UNITED STATES PATENT AND TRADEMARK OFFICE

CERTIFICATE OF CORRECTION

PATENT NO. : 5,676,276

DATED : October 14, 1997

INVENTOR(S) : David J. Zielinski et al.

It is certified that error appears in the above-identified patent and that said Letters Patent is hereby corrected as shown below:

Sheet 2 of 2, FIG. 2, delete "88" and substitute --11-- therefor.

Claim 16, line 2 (column 6, line 2), delete "recessed" and insert --recesses-- therefor.

Signed and Sealed this

Twenty-third Day of December, 1997

Bruce Lehman

*Attest:*

BRUCE LEHMAN

*Attesting Officer*

*Commissioner of Patents and Trademarks*